US010933288B2

(12) United States Patent
Chung

(10) Patent No.: US 10,933,288 B2
(45) **Date of Patent: *Mar. 2, 2021**

(54) GOLF PUTTER WITH ADJUSTABLE COUNTERBALANCE WEIGHT SYSTEM

(71) Applicant: Sense Golf Grip Inc., Chino, CA (US)

(72) Inventor: Andrew Chung, Chino, CA (US)

(73) Assignee: Sense Golf Grip, Inc., Chino, CA (US)

( * ) Notice: Subject to any disclaimer, the term of this patent is extended or adjusted under 35 U.S.C. 154(b) by 28 days.

This patent is subject to a terminal disclaimer.

(21) Appl. No.: 16/601,389

(22) Filed: Oct. 14, 2019

(65) Prior Publication Data

US 2020/0038727 A1 Feb. 6, 2020

Related U.S. Application Data

(63) Continuation of application No. 16/026,417, filed on Jul. 3, 2018, now Pat. No. 10,441,860.

(51) Int. Cl.
*A63B 53/14* (2015.01)
*A63B 60/24* (2015.01)
*A63B 53/00* (2015.01)

(52) U.S. Cl.
CPC ..... *A63B 60/24* (2015.10); *A63B 53/007* (2013.01); *A63B 53/14* (2013.01)

(58) Field of Classification Search
CPC ..... A63B 60/24; A63B 60/22; A63B 60/26; A63B 60/10; A63B 60/12; A63B 53/14; A63B 60/32; A63B 53/145; A63B 53/007
USPC ..... 473/297, 303, 302, 300, 292, 313, 318
See application file for complete search history.

(56) References Cited

U.S. PATENT DOCUMENTS

| | | | | |
|---|---|---|---|---|
| 5,478,075 | A * | 12/1995 | Saia | A63B 53/00 473/238 |
| 6,394,909 | B1 * | 5/2002 | Laibangyang | A63B 53/10 473/232 |
| 8,328,657 | B1 * | 12/2012 | Demkowski | A63B 53/12 473/296 |
| 10,441,860 | B1 * | 10/2019 | Chung | A63B 53/14 |
| 2008/0274822 | A1 * | 11/2008 | Lindner | A63B 53/00 473/297 |

* cited by examiner

*Primary Examiner* — Benjamin Layno
(74) *Attorney, Agent, or Firm* — Raymond Sun

(57) ABSTRACT

A golf putter has a hollow shaft that has a longitudinal channel, a grip that surrounds a portion of the shaft, a putter head, and an adjustable counter-balance weight system. The weight system has a rod that has a four-sided configuration and at least one weight. Each weight has an annular weight housing that has a four-sided channel extending longitudinally therethrough, and with each weight housing having a threaded opening. The rod extends through the channel of the weight housing of the at least one weight, and a threaded setting screw is threaded through the threaded opening and impinges on one of the four sides of the rod to secure the weight inside the four-sided channel.

9 Claims, 4 Drawing Sheets

GOLF PUTTER WITH ADJUSTABLE COUNTERBALANCE WEIGHT SYSTEM

BACKGROUND OF THE INVENTION

1. Field of the Invention

The present invention relates to golf clubs, and in particular, to a golf putter having an adjustable counterbalance weight system.

2. Description of the Prior Art

Putting is one of the most precise aspects of the game of golf. It requires a considerable amount of consistency to properly align and strike a ball so that it rolls on an intended line for a desired distance. To facilitate a consistent stroke, many golfers look favorably on a putter that provides smooth stroke, good glide, pure impact, and a bounce-less topspin ball launch.

One attempt to remove uncertainty in a putting stroke has been to anchor an extended length putter into the midsection of the golfer. Doing so reduces the total number of degrees of freedom that must be successfully controlled to provide a smooth, substantially planar stroke. Such a practice has been prohibited by rules established by the USGA and R&A rule making bodies. As such, club manufacturers have taken on a renewed interest in the design of the putter to fill the void left by the prohibition on anchored-style putters.

As a result, some manufacturers have introduced counterbalanced putters. Counterbalancing offers many of the benefits of anchored-style putters without anchoring. By adding weight to the grip end of the club, it raises the putter's balance point. Putting more weight in the hands aims to increase control for better tempo, stability and consistency.

Unfortunately, not all the counterbalanced putters on the market are effective. The putter grip market that is offered to the public today all provide static weights (i.e., the weights cannot be positioned to the user's preference). There are also counterbalanced putters that have a single weight that is installed on the butt end of the grip. There are other systems that are able to change the positions of the weight(s), but will require the removal of the grip to re-position the weight(s), and then the user will have to put the grip back on. This process makes it very difficult for someone to adjust or change the weights at home.

SUMMARY OF THE INVENTION

It is an object of the present invention to provide a putter having a counterbalanced weight system that overcomes the drawbacks of the prior art.

The present invention provides a golf putter having a hollow shaft that has a longitudinal channel, a grip that surrounds a portion of the shaft, a putter head, and an adjustable counter-balance weight system. The weight system has a rod that has a four-sided configuration and at least one weight. Each weight has an annular weight housing that has a four-sided channel extending longitudinally there through, and with each weight housing having a threaded opening. The rod extends through the channel of the weight housing of the weight, and a threaded setting screw is threaded through the threaded opening and impinges on one of the four sides of the rod to secure the weight inside the four-sided channel.

The present invention allows the end user to adjust the amount of weight and the desired position of the weights within the golf putter, without removing the grip or being at a set location within the golf putter.

DETAILED DESCRIPTION OF THE PREFERRED EMBODIMENTS

Figure 1:
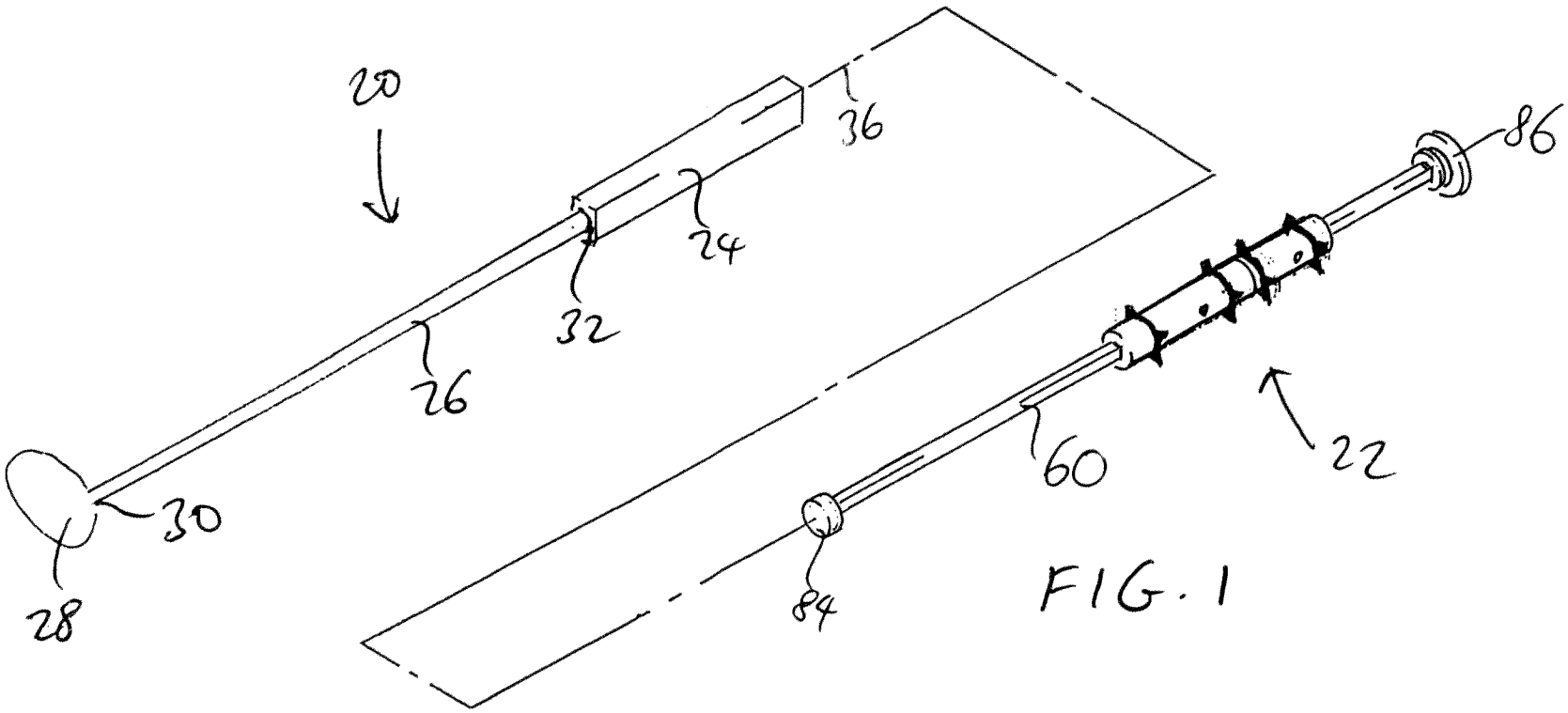
FIG. 1 is an exploded perspective view of a putter and a weight system according to one embodiment of the present invention.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

FIGS. 1-4 illustrate a golf putter 20 having a counterbalance weight system 22 according to one embodiment of the present invention. The putter 20 has a grip 24, a hollow shaft 26 and putting head 28. The shaft 26 is generally disposed along a longitudinal axis 36 that extends between a first end 30 and a second end 32 of the shaft 26. The putting head 28 is affixed to the first end 30 of the shaft 26, and the grip 24 is circumferentially disposed about the outside of the shaft 26 such that the grip 24 abuts the second end 32. In general, the grip 24 may be a non-metallic wrap or sleeve that is gripped by a user when swinging the club. Suitable materials for the grip typically include a rubber, leather, or synthetic leather material. The putter head 28 can have a loft angle of from about 0 degrees to about 6 degrees, and a head mass of from about 200 g to about 500 g.

As shown, the shaft 26 includes a tubular body 38 having an inner surface and an outer surface that are substantially concentric and aligned with the longitudinal axis 36. The grip 24 is disposed about the outer surface, and the inner surface defines a hollow channel 40. An adjustable counterbalance weight system 22 may be disposed within the hollow channel 40, and may enable one or more weights 44, 46 to be adjustably positioned at a user-intended location within the shaft 26. By repositioning the weights 44, 46 within the shaft 26, the user may alter the feel and response of the putter 20 when it is swung. For certain placements and sizes of the weights 44, 46, the feel or swing profile of the putter 20 may be similar to that of an anchored putter.

The adjustable counterbalance weight system 22 includes an elongate fiber rod 60 that is configured to be substantially aligned with the longitudinal axis 36 of the shaft 26. The fiber rod 60 may be formed from a suitably light weight, yet resilient material, such as, for example, an aluminum, a carbon fiber-wrapped aluminum, and/or a polymeric material. Examples of suitable polymers may include one or more polyamides, polyimides, polyamide-imides, polyetheretherketones (PEEK), polycarbonates, engineering polyurethanes, and/or other similar materials. In general, the polymeric material may be a either thermoplastic or thermoset, and may be unfilled, filled with a chopped fiber such as a glass fiber or a carbon fiber, or may have other suitable fillers and/or additives to promote increased strength. The rod 60 may have a diameter that is from about 40% to about 60% of the diameter of the channel 40. Likewise, the rod 60 may have a length of from about 12-16 inches.

Figure 3:
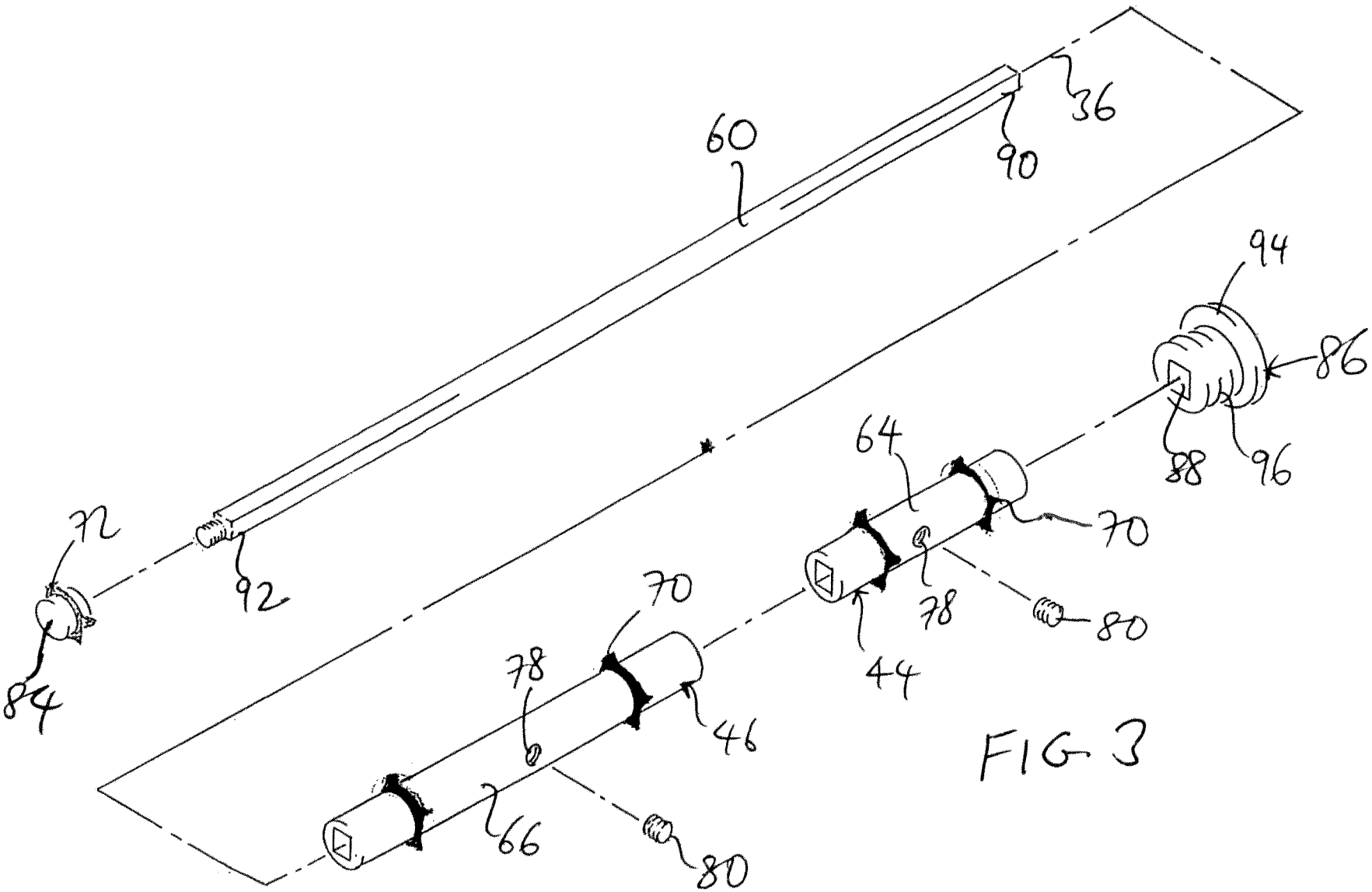
FIG. 3 is exploded perspective view of the weight system of FIG. 1.

As best shown in FIG. 3, the rod 60 has a four-sided cross-sectional configuration. The rod 60 shown herein has a generally square configuration, but it is also possible to provide the rod 60 in a rectangular or diamond-shaped configuration.

Figure 4:
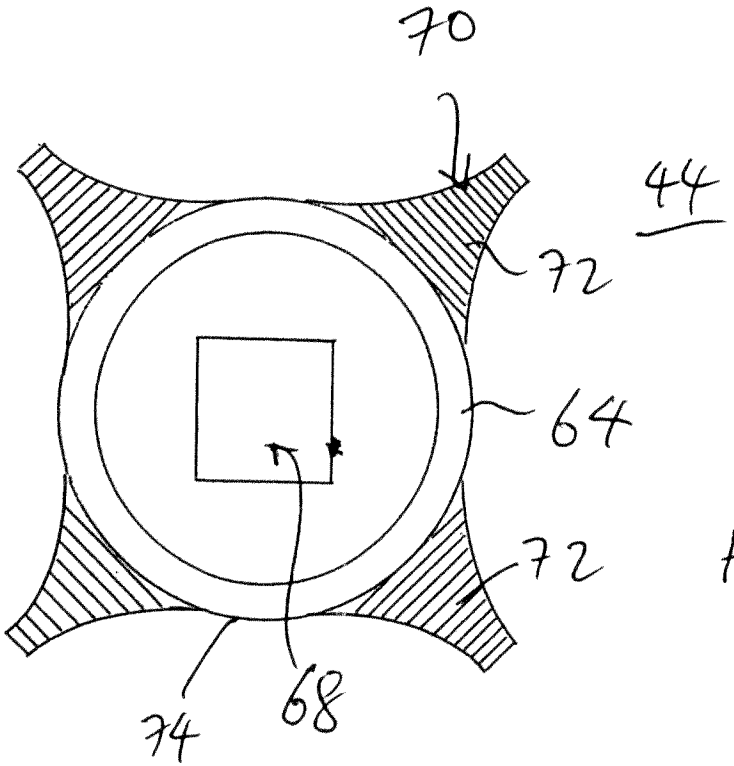
FIG. 4 is a cross-sectional view of the grip of FIG. 2 taken along line A—A.

The adjustable counterbalance weight system 22 further includes at least one weight. In the embodiment shown in FIGS. 1-4, two weights 44, 46 are shown but it is possible to implement the weight system 22 with any number of weights. Each weight 44 and 46 has an annular weight housing 64 and 66, respectively, and also has a four-sided channel 68 extending through the weight housing 64, 66 along the longitudinal axis 36. The four-sided configuration of the channel 68 is matched with the four-sided configuration of the rod 60, with the dimensions of the channel 68 being slightly larger than those of the rod 60, so that the rod 60 can extend through the channel 68. In addition, one or more rubber bushings 70 can be provided in spaced-apart manner around the outer surface of each weight member 44, 46. As best shown in FIG. 4, each rubber bushing 70 has a plurality of extensions 72 that extend radially outwardly from the outer surface 74 of the weight housing 64 or 66. FIGS. 1-4 show four extensions 72, but there should be at least three or more extensions 72. In addition, a threaded opening 78 is provided in the body of each weight housing 64, 66, and is adapted to receive a setting screw 80.

Each of the weight housings 64, 66 is preferably made of a metal, metal alloy, or any material to a desired weight, and examples include brass, aluminum, steel, or carbon fiber material. In addition, the bushings 70 are preferably made of a soft material that will remove the vibrations of the weight when making a putting stroke, and examples include rubber, silicon, or plastics.

A front cap 84 can be threadably engaged in reverse with the end 92 of the rod 60 closest to the putter head 28, and an end cap 86 can be provided at the opposite end adjacent the grip 24. Extensions 72 can also be provided and spaced-apart around the outer surface of the front cap 84. The end cap 86 can be provided with a four-sided bore 88 that matches the four-sided configuration of the rod 60, so that the end 90 of the rod 60 can be snugly retained inside the bore 88.

Figure 2:
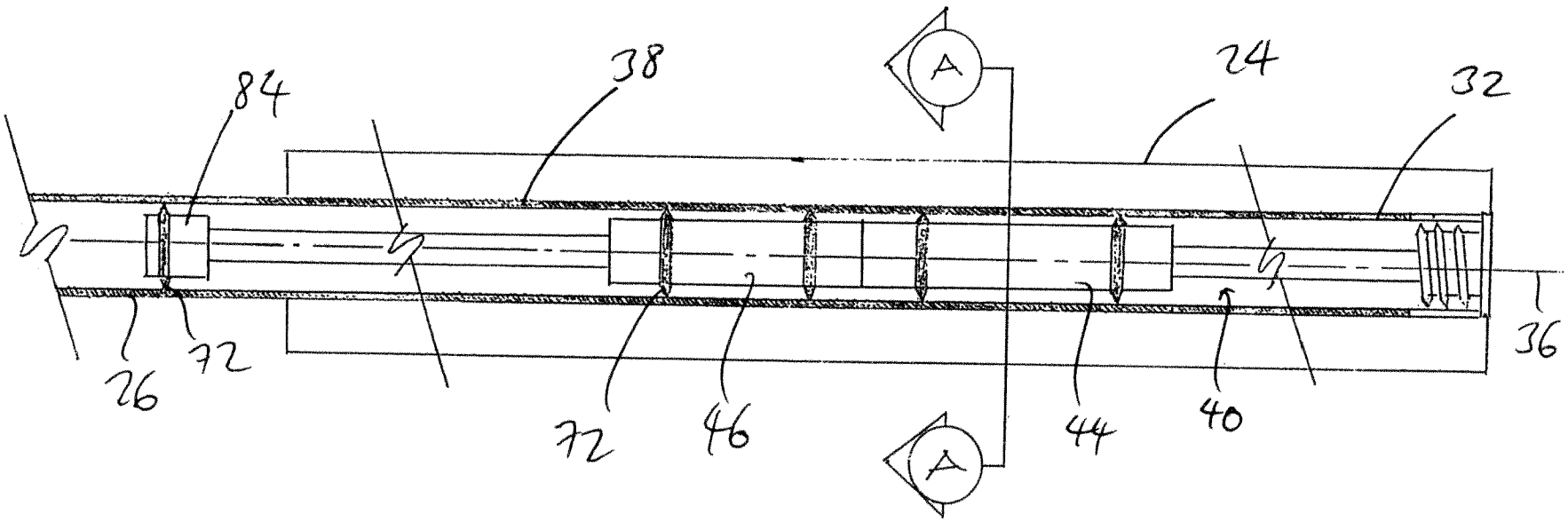
FIG. 2 is an enlarged sectional view of the grip of the putter of FIG. 1.

Each weight housing 64 and 66 may be generally annular in nature and may radially surround the rod 60. Each weight housing 64, 66 may be selectively affixed to the rod 60 to facilitate a semi-permanent placement of the weight 44, 46. To affix the weight 44 or 46 to the desired location along the rod 60, the weight housing 64 or 66 is slid over the rod 60 with the rod 60 extending through the channel 68 to the desired location. The setting screw 80 is then threaded through the threaded opening 78 until the end of the screw 80 impinges against one of the four sides of the rod 60. This secures the weight 44 or 46 at the desired location along the rod 60. The weight system 22 is then slid into the channel 40 of the shaft 26, and the extensions 72 help to position the weights 44, 46 and the front cap 84 in the center of the channel 40 inside the shaft 26. As shown in FIG. 2, all the weights 44, 46 are preferably positioned inside the shaft 26 within the grip portion, with the front cap 84 in the shaft 26 outside of the grip portion. The end cap 86 has a flange 94 that covers the open upper end of the grip 24 and the stem portion 96 of the end cap 86 secures the weight system 22 at the upper end of the grip 24.

The weight 44 or 46 can be easily removed by first removing the end cap 86 and the weight system 22, and then unscrewing the screw 80 and removing the weights 44 and/or 46. In use, the user can use any number of weights 44, 46 depending on the counterbalancing effect desired by the user, with total mass of all the weights (one or more weights) being a "movable mass". The weight system 22 can be provided with a plurality of different weights that have different masses so that the user can choose between a wide variety of counterbalancing options. For example, the user can use a single 30 gram weight, or a combination of a 30 gram and a 10 gram weight in different positions of the rod 60.

The entire mass of the adjustable counterbalance may be from about 15 g to about 120 g, which includes from about 10 g to about 100 g of movable mass, and about 15 g of fixed mass (i.e., mass of the rod 60 and other stationary components). In one configuration, the grip 24 may define a "grip portion" of the club. The grip portion may have a total fixed mass (i.e., the mass of the non-repositionable elements) that is from about 60 g to about 120 g. In another embodiment, the total fixed mass of the grip portion is from about 80 g to about 100 g. In one particular embodiment, the total fixed mass of the grip portion may be about 90 g.

To provide the most optimal feel and adjustability to a golfer, the amount of the movable mass may fall within certain proportions, such as expressed by the ratio of movable mass to head mass and/or to the fixed mass within the grip portion. In one configuration, the ratio of the head mass to the movable mass may be from about 3:1 to about 11:1, or from about 3:1 to about 8:1, or even from about 4:1 to about 6:1. In a particular example, the ratio of the head mass to the movable mass may be about 4.3:1. Likewise, the ratio of the fixed grip mass to the movable mass may be from about 0.5:1 to about 4:1, or from about 0.5:1 to about 2:1, or even from about 0.75:1 to about 1.5:1. In a particular example, the ratio of the fixed grip mass to the movable mass may be about 1.2:1.

Studies have shown that one will better control of a club when the center of gravity of the club is closer to the hands. With the weight system of the present invention, not only does one have the ability to move the center of gravity towards the hands, but to also position it to a specific location within the club without the need to have a golf club smith to do so. Studies have also shown that one will have much more control of the club with the majority of the weight placed under the dominant hand of the player.

Today's options only allow the user to add a static weight at the end of the club, or have a club smith place a static weight inside the shaft by removing the grip, placing the weight, and then reinstalling another grip. The present invention will allow the end user to adjust and reinstall the weight system in their home with the use of an included tool.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A golf putter, comprising a hollow shaft that has a longitudinal channel, a grip that surrounds a portion of the shaft, a putter head, and an adjustable counter-balance weight system that is positioned inside the longitudinal channel of the hollow shaft, the weight system comprising:

a rod;

at least one weight, each of the at least one weight having an annular weight housing that has a channel extending longitudinally therethrough;

wherein the rod extends through the channel of the weight housing of the at least one weight; and wherein each weight further includes at least one bushing surrounding the weight housing, the bushing having a plurality of extensions, with the weight housing positioned inside the channel of the shaft and the plurality of extensions impinging against the channel of the shaft to center the weight inside the channel of the shaft.

2. The golf putter of claim 1, wherein each weight housing has a threaded opening, and the weight system further includes a threaded setting screw that is threaded through the threaded opening and impinges on the rod.

3. The golf putter of claim 1, wherein the rod extends through the entire channel of the weight housing of the at least one weight.

4. The golf putter of claim 1, wherein the bushing and the weight housing are made from different materials.

5. The golf putter of claim 1, wherein the at least one weight is positioned inside the grip.

6. The golf putter of claim 1, wherein the at least one weight comprises a first weight and a second weight that are positioned in spaced-apart manner along the rod.

7. The golf putter of claim 1, wherein the rod has a first end and a second end, the weight system further including an end cap that has a four-sided bore for retaining the second end of the rod.

8. The golf putter of claim 7, wherein the weight system further includes a front cap that is threadably engaged in reverse with the first end of the rod, and which is positioned inside the putter head.

9. The golf putter of claim 1, wherein the rod has a length with opposite ends, and wherein the at least one weight is positioned along the length of the rod at a location that is offset from both the opposite ends of the rod.

* * * * *